US011969635B1

(12) United States Patent
Basyuk et al.

(10) Patent No.: US 11,969,635 B1
(45) Date of Patent: Apr. 30, 2024

(54) THROWING GAME APPARATUS AND METHOD FOR PLAYING SAME

(71) Applicants: Simon Basyuk, Millburn, NJ (US); Yaroslav Basyuk, Gilford, NH (US)

(72) Inventors: Simon Basyuk, Millburn, NJ (US); Yaroslav Basyuk, Gilford, NH (US)

( * ) Notice: Subject to any disclaimer, the term of this patent is extended or adjusted under 35 U.S.C. 154(b) by 0 days.

(21) Appl. No.: 18/386,300

(22) Filed: Nov. 2, 2023

Related U.S. Application Data

(60) Provisional application No. 63/526,260, filed on Jul. 12, 2023.

(51) Int. Cl.
*A63B 67/06* (2006.01)

(52) U.S. Cl.
CPC ..... *A63B 67/06* (2013.01)

(58) Field of Classification Search
CPC ... A63B 63/06; A63B 2063/065; A63B 67/06; F41J 7/04
See application file for complete search history.

(56) References Cited

U.S. PATENT DOCUMENTS 157,335 A * 12/1874 Lyon ..... F41J 7/04 273/390
599,063 A * 2/1898 McCauley ..... F41J 7/04 273/390
687,873 A * 12/1901 Daniels ..... F41J 7/04 273/390
1,573,415 A 2/1926 Mendes
2,742,734 A 4/1956 Marras
2,967,712 A * 1/1961 Breitenfeldt ..... F41J 7/04 248/156
3,158,373 A 11/1964 Hastings
3,438,631 A 4/1969 Hines
3,643,951 A 2/1972 Breslow
3,680,864 A 8/1972 Peterson
3,713,654 A 1/1973 Goldfarb
3,929,334 A 12/1975 Magazzu
(Continued)

FOREIGN PATENT DOCUMENTS

DE 19636392 A1 * 5/1997 ..... A63B 63/06

OTHER PUBLICATIONS

English machine translation of DE-19636392-A1 (Frey) (Year: 1997).*

*Primary Examiner* — Laura Davison
(74) *Attorney, Agent, or Firm* — Walter J. Tencza, Jr.

(57) ABSTRACT

A game apparatus including an obstructing member connected to a target member. A front side of the target member lies substantially in a first plane. The front side of the target member has an area on the first plane. The obstructing member is rotationally supported by a supporting means; wherein the obstructing member is configured to rotate with respect to the target member; and the obstructing member is configured such that, when the obstructing member is in the first orientation with respect to the target member, a projectile having a sufficient velocity and mass striking a particular area of one of the protruding pieces will cause rotational movement of the obstructing member toward the second orientation so that another projectile propelled toward the front side of the target member can reach a portion of the front side of the target member that is not obstructed by the obstructing member.

18 Claims, 9 Drawing Sheets

(56) References Cited

U.S. PATENT DOCUMENTS

| | | | | |
|---|---|---|---|---|
| 4,344,628 | A * | 8/1982 | Warehime | A63B 63/06 273/127 R |
| 4,968,035 | A | 11/1990 | Furlong | |
| 6,398,215 | B1 | 6/2002 | Carroll | |
| 7,207,564 | B2 | 4/2007 | Bedford | |
| 7,611,146 | B2 | 11/2009 | Arden | |
| 7,731,196 | B2 | 6/2010 | Scoccia | |
| 7,850,551 | B2 | 12/2010 | Barber | |
| 8,403,326 | B1 | 3/2013 | Flanagan | |
| 8,540,592 | B1 | 9/2013 | Coppenrath | |
| 8,668,603 | B2 | 3/2014 | Hammons | |
| 8,678,957 | B1 | 3/2014 | Essex | |
| 8,807,570 | B1 | 8/2014 | Zalar | |
| 8,939,854 | B1 | 1/2015 | Jones, Sr. | |
| 10,132,600 | B2 * | 11/2018 | Saunders | F41J 3/0004 |
| 2004/0162166 | A1 * | 8/2004 | Tien | A63B 63/06 473/454 |
| 2008/0248901 | A1 * | 10/2008 | Mosier | A63B 71/0669 473/454 |

* cited by examiner

THROWING GAME APPARATUS AND METHOD FOR PLAYING SAME

CROSS REFERENCE TO RELATED APPLICATION(S)

The present application claims the priority of U.S. provisional patent application Ser. No. 63/526,260, titled "THROWING GAME APPARATUS AND METHOD FOR PLAYING SAME", filed on Jul. 12, 2023, inventor and applicant Simon Basyuk.

FIELD OF THE INVENTION

The invention relates to apparatus and methods for playing games.

BACKGROUND OF THE INVENTION

There are various apparatuses and methods related to playing games.

SUMMARY OF THE INVENTION

In at least one embodiment of the present invention a game apparatus is provided which includes an obstructing member, and a target member connected to the obstructing member. The target member may have a front side. The front side of the target member lies substantially in a first plane. The front side of the target member has an area on the first plane.

In at least one embodiment, the obstructing member is rotationally supported by a supporting means; wherein the obstructing member is configured to be rotated about a rotational axis from a first orientation to a second orientation; wherein in the first orientation, a projection of outside contour of the obstructing member on the first plane of the front side of the target member covers a first portion of the area of the front side; wherein in the second orientation, a projection of outside contour of the obstructing member on the first plane of the front side of the target member covers a second portion of the area of the front side that is smaller than the first portion of the area of the front side.

In at least one embodiment, the obstructing member includes a first protruding piece and a second protruding piece; wherein the first protruding piece projects out from the rotational axis in a first direction and the second protruding piece projects out from the rotational axis in a second direction which is different from the first direction.

In at least one embodiment, the target member and the obstructing member are connected such that the obstructing member is configured to rotate with respect to the target member; and the obstructing member is configured such that, when the obstructing member is in the first orientation with respect to the target member, a projectile having a sufficient velocity and mass striking a particular area of one of the protruding pieces will cause rotational movement of the obstructing member toward the second orientation so that another projectile propelled toward the front side of the target member can reach a portion of the front side of the target member that is not obstructed by the obstructing member.

In at least one embodiment of the present invention, the first and the second protruding pieces have a substantially the same shape. The first and the second protruding pieces may project out from the rotational axis in opposite directions.

In at least one embodiment of the present invention, the rotational axis is oriented substantially horizontally.

The second protruding piece may be heavier than the first protruding piece.

The target member may have a frame and a projectile capturing means positioned so that the frame is positioned between the obstructing member and the projectile capturing means, and the projectile capturing means is configured to capture projectiles passing through the frame from the front side of the target member, and into the projectile capturing means.

The projectile capturing means may have a tunnel having an upper portion attached to the frame. The projectile capturing means may have a projectile collector configured as a container positioned under an opening in lower portion of the tunnel.

In at least one embodiment of the present invention, the front side of the target member is solid, so that a projectile hitting the front side of the target member bounces off the front side of the target member unless the target member is broken.

The target member may be a plate made from a solid material.

The front side of the target member may be a loop with an opening at a center of the loop and the loop has a front side and a rear side.

The target member may have a projectile capturing means capable of capturing projectiles passing through the opening at the center of the loop from the front side of the loop. The projectile capturing means may be attached to the rear side of the loop.

The projectile capturing means may be configured as an elongated tube having a longitudinal opening facing the opening at the center of the loop.

The game apparatus may further include a base which connects the target member with the obstructing member.

The rotational axis may be oriented substantially horizontally or substantially vertically.

The game apparatus may further include a base which connects the target member with the obstructing member; wherein the rotational axis is oriented substantially parallel to the base.

In at least one embodiment of the present invention, the obstructing member is configured such that the obstructing member will remain in a stable state at the first orientation with respect to the target member, until there is a sufficient external force from a particular direction, which will cause the obstructing member to rotate with respect to the target member, and upon removal of the external force, the obstructing member will settle back into its stable state.

In at least one embodiment of the present invention a method is provided of playing a game with the game apparatus as previously described where projectiles are thrown towards the obstructing member in order to change the orientation of the obstructing member and thereby allow one or more projectiles to impact a target or pass through a goal or opening of the target member.

DETAILED DESCRIPTION OF THE DRAWINGS

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Figure 1:
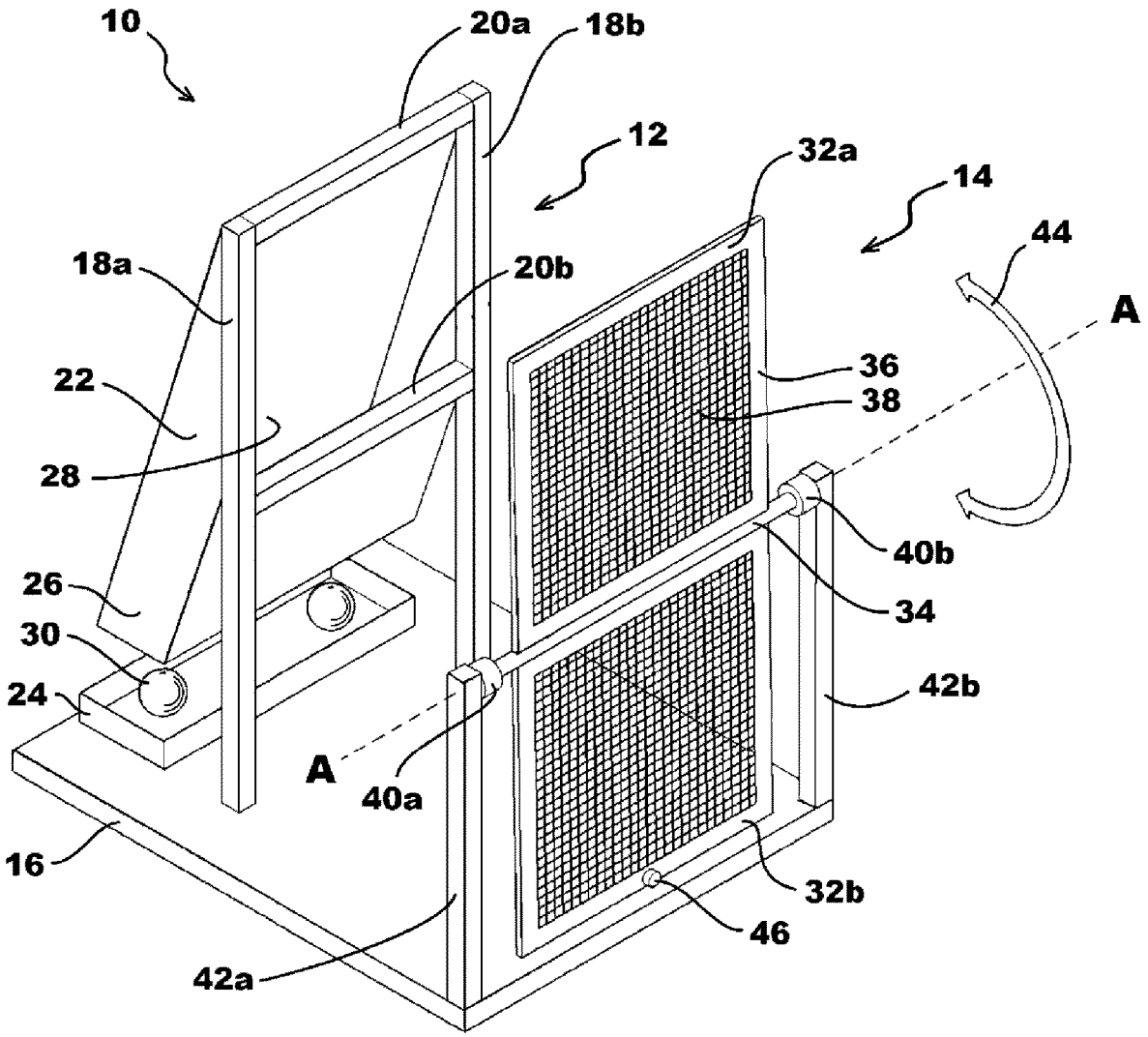
FIG. 1 is a perspective view of an apparatus in accordance with a first embodiment of the present invention.

FIGS. 1-4 show a game apparatus 10 constructed according to a first embodiment of the present invention. FIG. 1 is a perspective view of the game apparatus 10 having a goal 12 and an obstructor 14, both mounted on a horizontal plate 16. Vertical posts 18*a* and 18*b* are attached securely to plate 16. Goal 12 is a rectangular area surrounded by the horizontal bars 20*a* and 20*b*, and corresponding upper portions of the vertical posts 18*a* and 18*b*. Dimension of the goal 12 is, preferably: 10.0-12.0 inches width, 10.0-12.0 inches height.

As described hereinbelow, a player throws balls aiming at the goal 12. For catching the balls that get into the goal 12, the game apparatus 10 has a tunnel 22 and a ball collector 24.

Upper sections of the tunnel 22 are attached to horizontal bars 20*a* and 20*b* and to corresponding portions of vertical posts 18*a* and 18*b*. The tunnel 22 has an opening in its lower section 26. The tunnel 22 directs balls, such as including a ball 30, down to ball collector 24 that is a box placed on plate 16 under the tunnel's lower section 26. A back wall 28 of the tunnel 22 is made of an elastic or soft material able to absorb energy of a ball, such as ball 30, hitting the wall 28 so preventing the ball 30 from bouncing back. One of the balls ending up in ball collector 24 is the ball 30.

Obstructor 14 includes two rectangular lobes or protruding pieces: a lobe 32*a* and a lobe 32*b*, both attached longitudinally to a horizontal rotational shaft 34. Each of the lobes 32*a* and 32*b*, is implemented as a lightweight rectangular frame 36 across which a netting 38 is stretched tightly. Lobes 32*a* and 32*b* have equal shape and size. The lobes (or, rather, their associated planes) are parallel to each other. Rotational shaft 34 is extending along a horizontal axis A-A between left and right ends thereof. The left and right ends of rotational shaft 34 are supported by left and right bearings 40*a* and 40*b*, respectively. Bearings 40*a* and 40*b* are attached to upper portions of vertical poles 42*a* and 42*b*, respectively. Bottom portions of vertical poles 42*a* and 42*b* are attached securely to a front area of plate 16. A height of each of vertical poles 42*a* and 42*b* and a height of each of lobes 32*a* and a 32*b* are such that there is a clearance between an upper surface of plate 16 and a lowest portion of either of the lobes 32*a* and 32*b* when the obstructor 14 is oriented vertically, as shown in FIG. 1. It allows a rotational movement of the obstructor 14 about horizontal axis A-A, clockwise and counterclockwise, as illustrated by two-headed arrow 44.

While undisturbed, the obstructor 14 stays in vertical orientation, as shown in FIG. 1, due to a small weight 46 attached to the outward horizontal part of the frame of lobe 32*b*. The weight makes lobe 32*b* heavier than lobe 32*a*, so the obstructor stays in its original stable/equilibrium position having lobe 32*a* up and lobe 32*b* down as in FIG. 1.

Figure 2A:
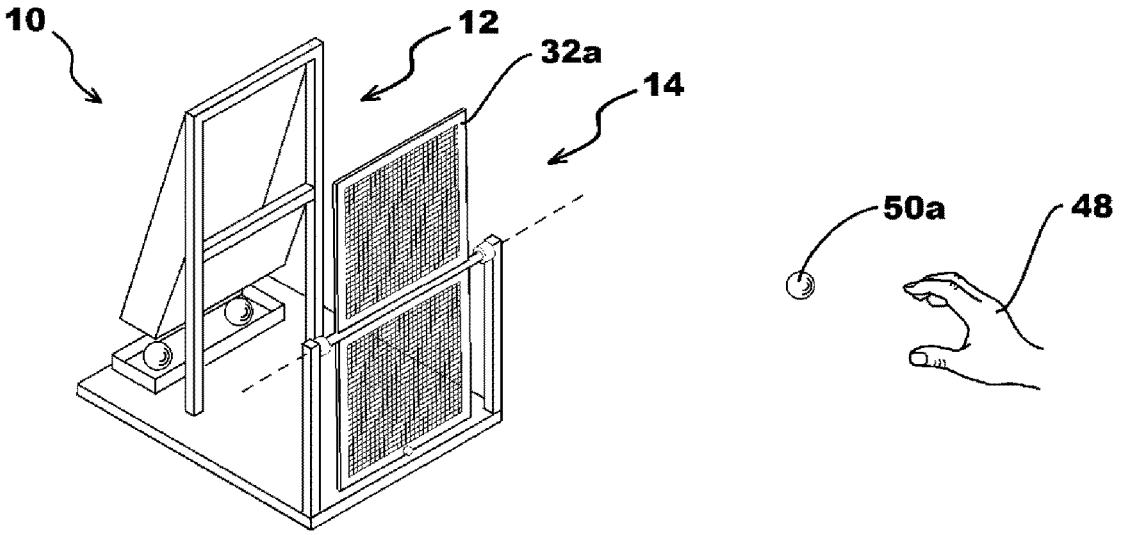
FIG. 2A is a perspective view of the apparatus of FIG. 1, illustrated while in-use, when a first ball is thrown.
Figure 2B:
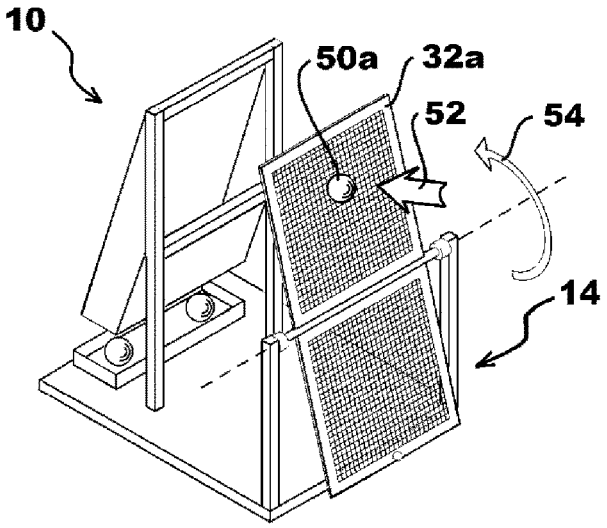
FIG. 2B is a perspective view of the apparatus of FIG. 1 when the first ball is hitting an obstructor.
Figure 2C:
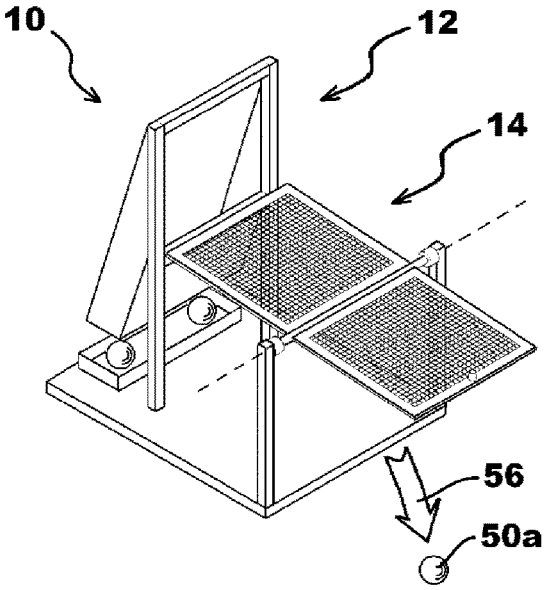
FIG. 2C is a perspective view of the apparatus of FIG. 1 when the obstructor has been turned.

Referring now to FIGS. 2A, 2B, 2C, 3A, 3B and 3C, these are consecutive snapshots of game apparatus 10 when it's in use. FIG. 2A illustrates a moment when a player or player's hand 48 throws a first ball 50*a* toward the game apparatus 10 (only player's hand 48 throwing the ball 50*a* is shown here). The ball 50*a* is preferably about 1.5 inches in diameter and made of a foam, similar to known balls used for indoor golf practice. The player is positioned relatively to the game apparatus 10 such that upper lobe 32*a* is on an imaginary line between goal 12 and the player so the upper lobe 32*a* obstructs the goal 12. Preferably, the player is ten to twelve feet away from the obstructor 14. Throwing the ball 50*a*, the player aims at upper lobe 32*a* in order to make the obstructor 14 turn thereby exposing or leaving the goal 12 unobstructed. FIG. 2B illustrates a moment when the ball 50*a* hits the netting of upper lobe 32*a* as indicated by an arrow 52. As the result of the impact, obstructor 14 starts turning about axis A-A in counterclockwise direction as indicated by an arrow 54. FIG. 2C illustrates a moment when the obstructor 14, due to rotational inertia, is turned counterclockwise still further, thereby making goal 12 fully exposed. The first ball

50*a*, being bounced back by upper lobe 32*a*, is landed nearby the game apparatus 10, in FIG. 2C, as indicated by an arrow 56.

Figure 2D:
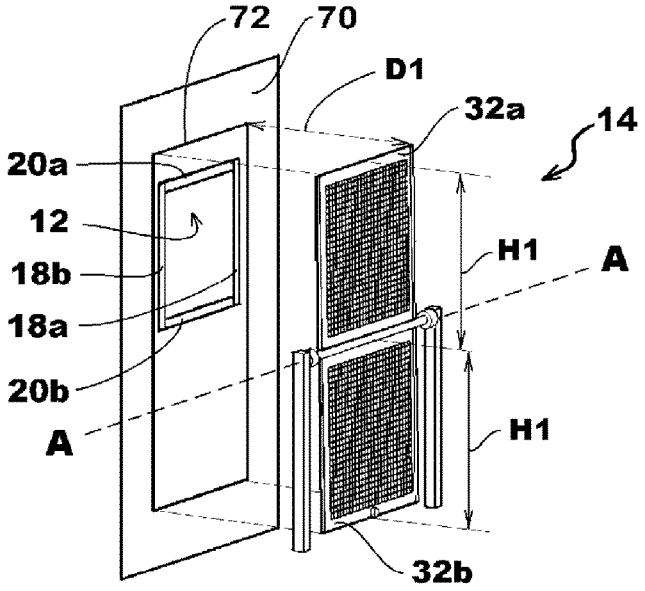
FIG. 2D is a simplified perspective view of part of the apparatus of FIG. 1, which explains at least part of the operation of various components of FIG. 1.

FIG. 2D schematically illustrates a position of the obstructor 14 relative to the goal 12, of the game apparatus 10 in the state as per FIG. 2A. Here, a vertical plane 70 is a plane of front side of the goal. The plane touches front surfaces of the goal's vertical posts 18*a* and 18*b* and horizontal bars 20*a,b*. (Lower portions of the vertical posts 18*a* and 18*b*, tunnel 22 and base 16 are not shown in FIG. 2D). A line 72 on the plane 70 illustrates a projection of outside contour of the obstructor 14 on the plane. As it is seen, the projection covers 100% of area of the goal 12. With different orientations of the obstructor 14, a portion of the area of the goal 12 that is covered by corresponding projections of outside contour of the obstructor 14, can be much smaller than 100%. For instance, with orientation of the obstructor 14 illustrated on FIG. 2C, less than 10% of area of the goal 12 is covered by projection of the obstructor. A distance D1 is shown between the plane 70 and the obstructor 14 when the latter is in vertical orientation, substantially parallel to the plane 70. To ensure a clearance between the plane 70 and the protruding pieces or lobes 32*a* and 32*b* of the obstructor 14 when it is in horizontal position, substantially perpendicular to the plane 70, distance D1 must be longer than a height H1 of each of the lobes or protruding pieces 32*a* and 32*b*. The height H1 is perpendicular to the axis A-A. In at least one embodiment, the axis A-A is typically parallel to the plane 70. On the other hand, the distance D1 should not be longer than height H1 multiplied by factor four, otherwise the player would be able to easily throw the balls at the goal 12 over the obstructor 14. The axis of rotation A-A, and/or a shaft which makes up the axis of rotation, in at least one embodiment, is elongated and has a length which is about the width of the goal 12 and/or an opening of the goal 12.

A note. In order to keep size of the drawings acceptable, in FIGS. 2A, 3A and others the player's hand 48 is shown much closer to the game apparatus 10 than they would be in practice.

Figure 3A:
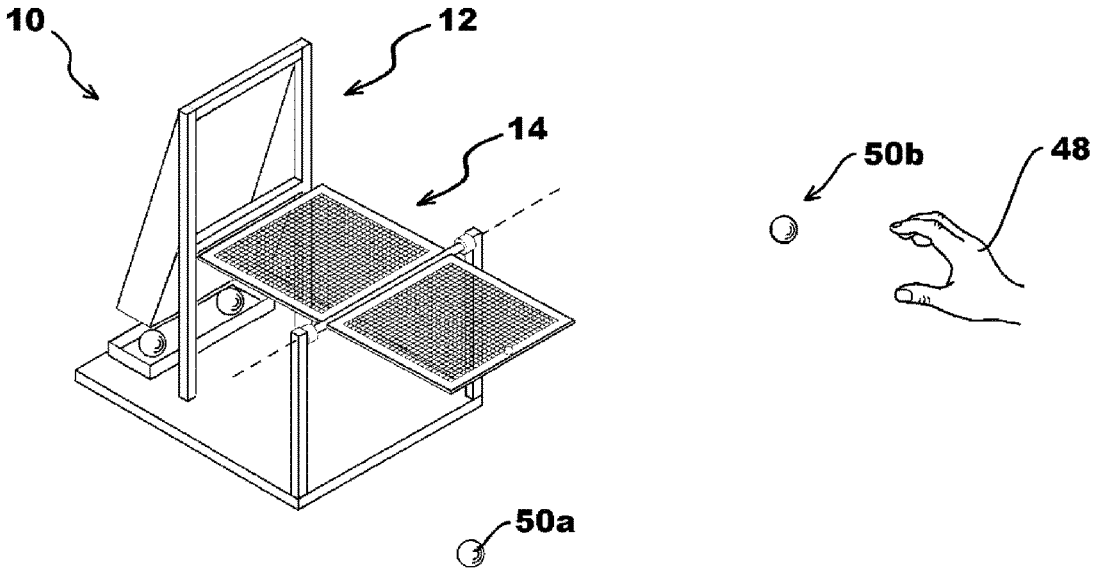
FIG. 3A is a perspective view of the apparatus of FIG. 1, illustrated while in-use, when a second ball is thrown.
Figure 3B:
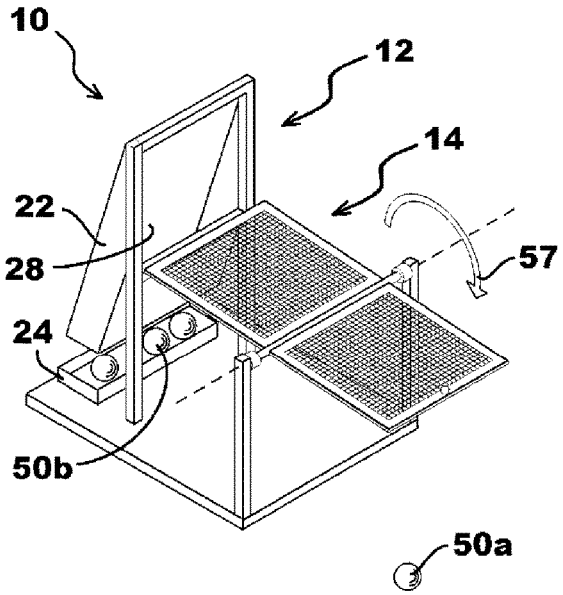
FIG. 3B is a perspective view of the apparatus of FIG. 1 after the second ball has gotten into a goal.
Figure 3C:
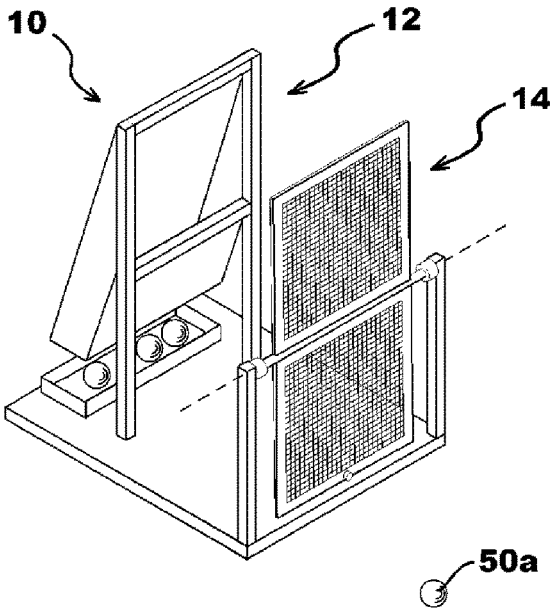
FIG. 3C is a perspective view of the apparatus of FIG. 1, when the obstructor is back to its original position.

As soon as goal 12 gets exposed, the player throws a second ball 50*b* at the goal 12 as illustrated in FIG. 3A. FIG. 3B illustrates a scenario when the throw of the ball 50*b* was successful so the second ball 50*b* got into the goal 12, hits back wall 28 of tunnel 22 and ends up in ball collector 24. In the moment illustrated in FIG. 3B, the obstructor 14 already lost its rotational inertia (caused by the impact of the first ball 50*a*) and, due to force of gravity, is returning back to the original stable position, shown in FIG. 3C turning clockwise as indicated by an arrow 57. FIG. 3C illustrates a moment when the obstructor 14 is back to its original position so making the goal 12 obstructed again.

In at least one embodiment, each player is provided with a set of, for instance, eight balls. The objective of the game is to get as many balls as possible in ball collector 24 by throwing them, one after another, alternatively at the obstructor 14 (to make the goal 12 exposed) and at the goal 12. A challenge of the game is to throw a ball at the goal 12 in a short period of time while the goal 12 is being exposed. Depending on configuration of the obstructor 14, that time period can be around one or two seconds. One of the factors affecting speed of the obstructor's rotation is size of mesh of netting 38 (in FIG. 1): smaller mesh makes the obstructor 14 slower because that cause an increase in air resistance of the lobes 32*a* and 32*b* while they are in motion.

Figure 4:
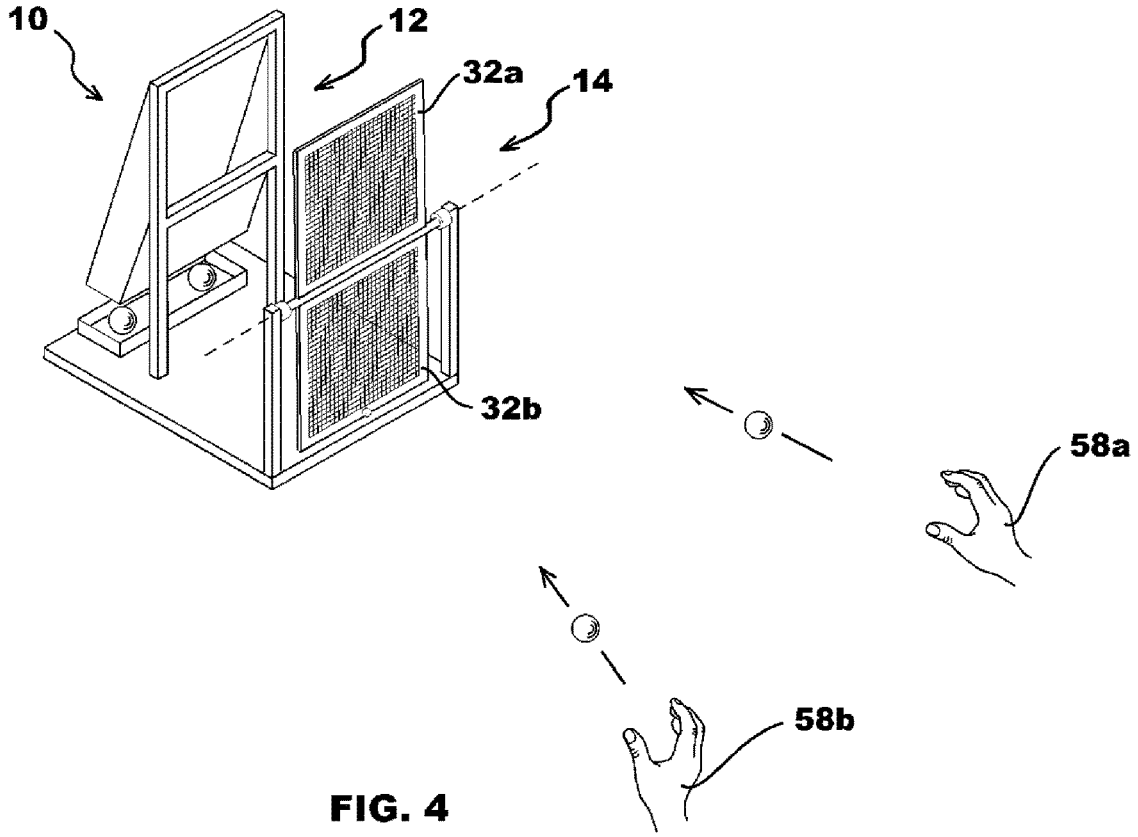
FIG. 4 is a perspective view of the apparatus of FIG. 1, illustrated while in-use, with two players.

In at least one embodiment, game apparatus 10 can be used in a competitive game. FIG. 4 illustrates the game played by two players. As an example, each of players 58*a* and 58*b* is provided with a set of eight balls, wherein the sets, in at least one embodiment, have a distinct color: blue and red. The players determine who throws a "starter" ball, that is the ball that would make the obstructor turning. For instance, player 58*a* throws the first ball at the obstructor 14. If unsuccessful, he/she keeps throwing the balls consecutively and/or sequentially until a thrown ball makes the obstructor 14 turn. In this case the players start throwing the balls at the goal 12 (or at the obstructor 14 if necessary). During the game, whenever the obstructor 14 stops moving and stands still, the players throw a new "starter ball" alternatively. When both players have no more available balls to throw, the round of the game is over. Counting the balls in the ball collector 24 (considering their colors) determines which of the players wins the round. Then the players can start a new round.

It should be understood that different embodiments of game apparatus per the current invention are contemplated. For instance, the goal 12 can have a different than rectangular shape, for instance, an oval shape.

Figure 5:
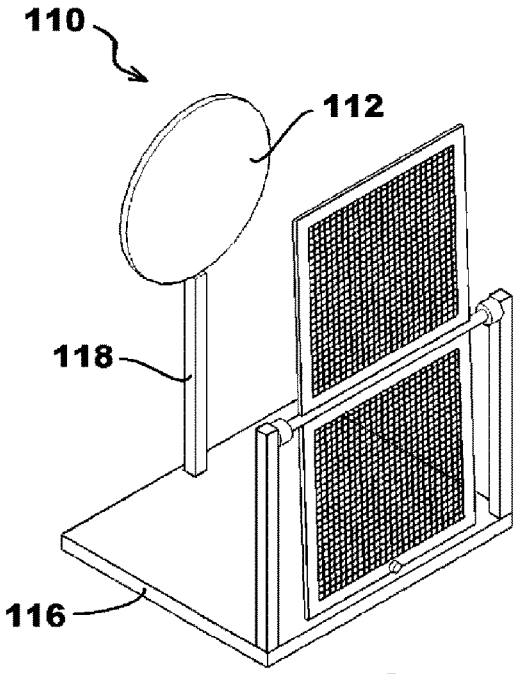
FIG. 5 is a perspective view of an apparatus of a second embodiment of the present invention, which has a target.

FIG. 5 is a perspective view of a game apparatus 110 having a target 112 instead of the goal 12 of FIG. 1. Target 112 is mounted on the top of a vertical pole 118; a lower end of the pole 118 is attached to a horizontal plate 116. The target 112 can be made of a thin hard material such that sound of a ball hitting the target 112 can be distinctly heard.

Figure 6A:
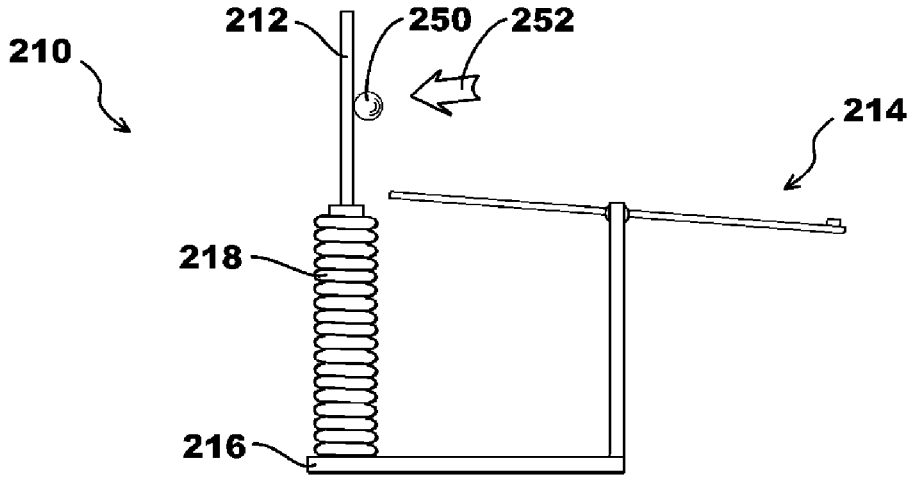
FIG. 6A is a side view of an apparatus of a third embodiment of the present invention, which has a target mounted on a spring, with the target shown in a first state just prior to being impacted by a ball.
Figure 6B:
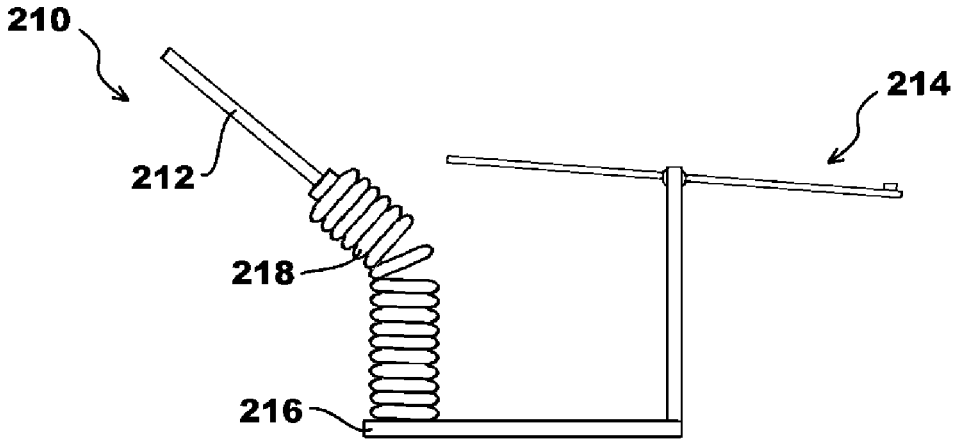
FIG. 6B is a side view of the apparatus of FIG. 6A, with the target shown in a second state after being impacted by a ball.

FIGS. 6A and 6B are side views of a game apparatus 210 having a target 212 that can be knocked down by a ball hitting the target 212. The target 212 is mounted on top of a flexible spring 218 that is positioned vertically; bottom of the spring 218 is securely attached to a plate 216. The spring 218 can be easily bent when a transverse force is applied. Initially, the target 212 is in vertical position. FIG. 6A illustrates a moment of time when an obstructor 214 is oriented almost horizontally so the target 212 is being exposed. A ball 250 thrown by a player hits the front surface of the target 212 as indicated by an arrow 252. The impact causes the spring 218 to bend putting the target 212 in an inclined position as illustrated in FIG. 6B. The inclination in FIG. 6B is a direct proof that the ball 250 hit the target 212. After a short period of time the spring 218 returns to its original shape, shown in FIG. 6A bringing the target 212 back to vertical position.

Figure 7:
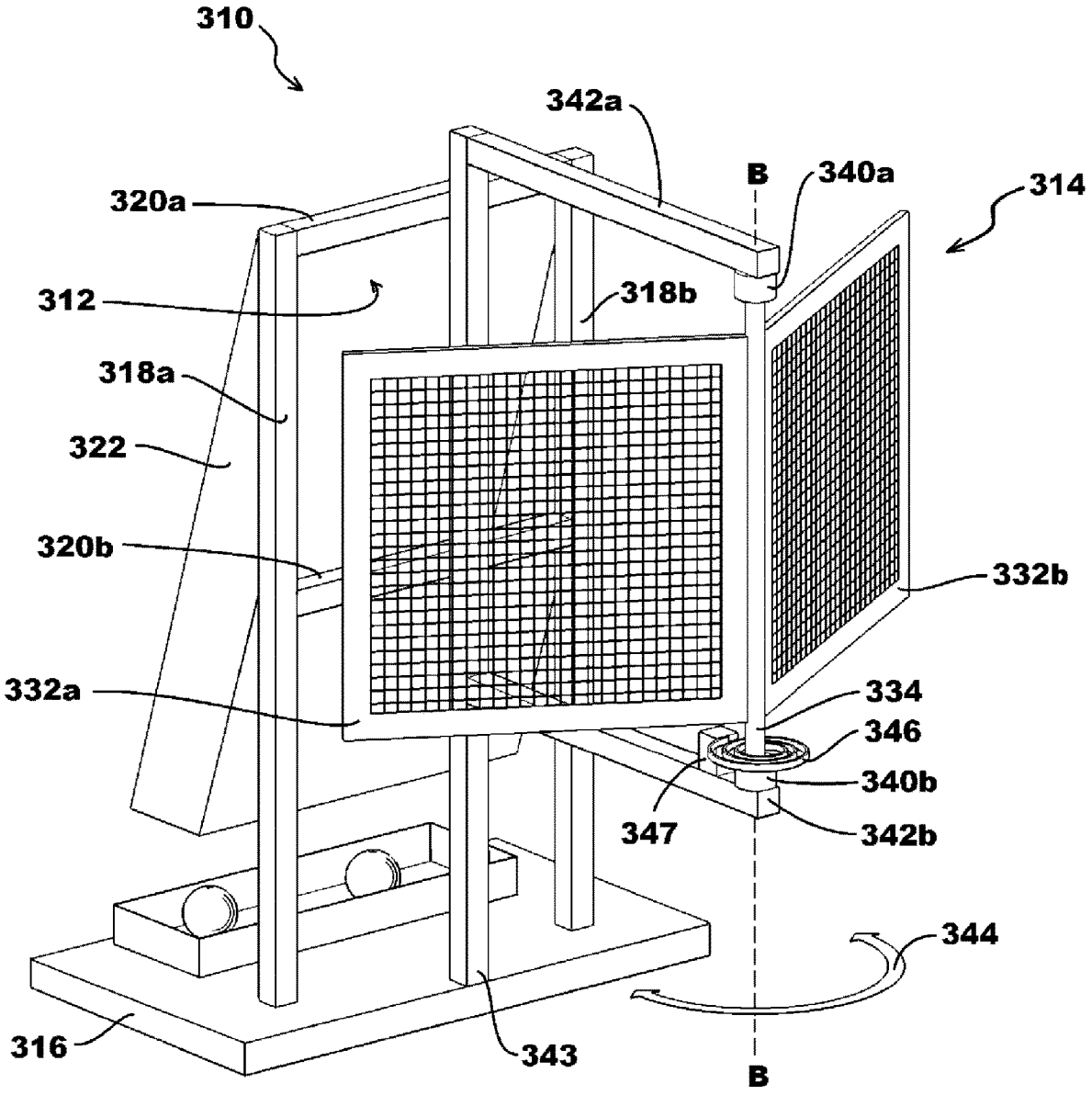
FIG. 7 is a perspective view of a fourth embodiment the present invention having vertical orientation of rotational shaft.
Figure 8A:
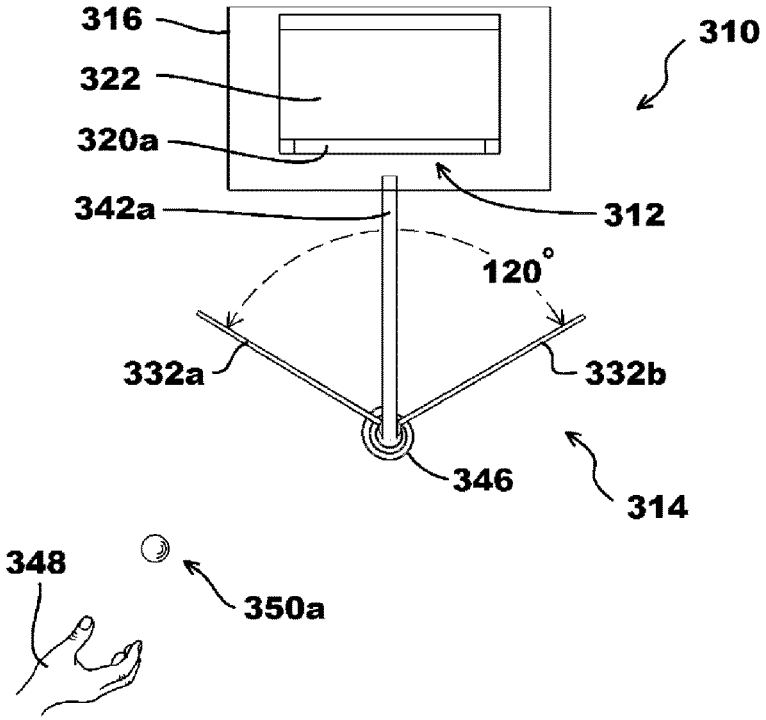
FIG. 8A is a top view of the embodiment illustrated in FIG. 7, when a ball is thrown.
Figure 8B:
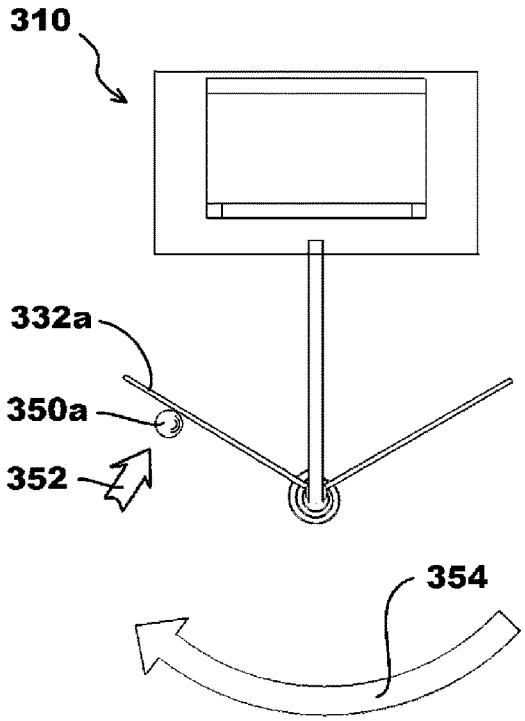
FIG. 8B is a top view of the embodiment illustrated in FIG. 7, with a ball hitting a left lobe or left protruding piece.
Figure 8C:
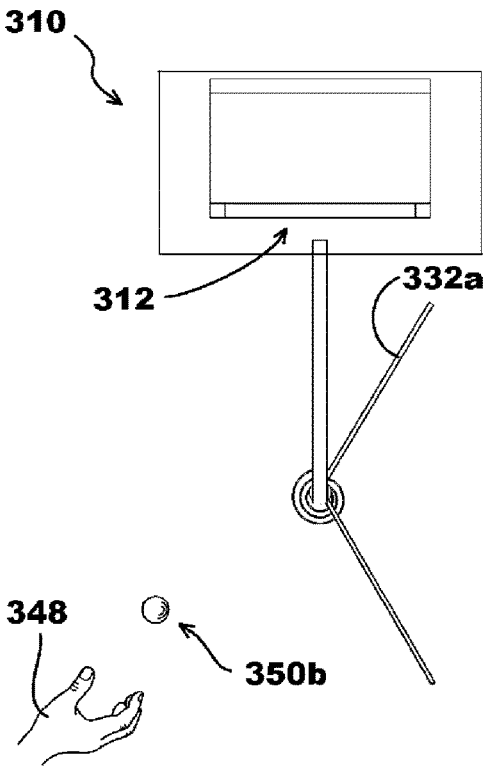
FIG. 8C is a top view of the embodiment illustrated in FIG. 7, when another ball, in addition to the ball through in FIG. 8A, is thrown.
Figure 9:
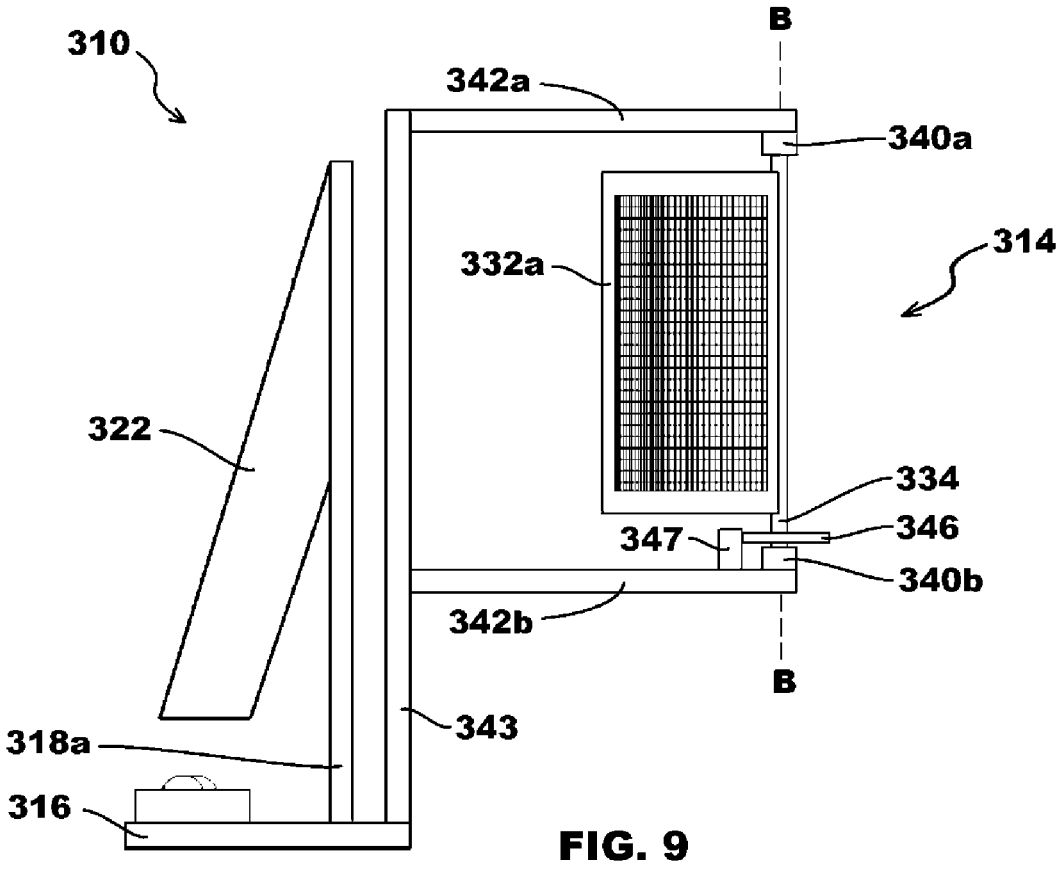
FIG. 9 is a side view of the embodiment illustrated in FIG. 7.

Further, an embodiment of the game apparatus with a different orientation of its obstructor is illustrated in FIG. 7 (a perspective view), in FIGS. 8A, 8B and 8C (views from above) and in FIG. 9 (a side view). A game apparatus 310, similar to the game apparatus 10 (in FIG. 1), has a goal 312 defined by vertical posts 318*a* and 318*b* and horizontal bars 320*a* and 320*b*. A tunnel 322 is attached to the vertical posts 318*a* and 318*b* and the horizontal bars 320*a* and 320*b*. An obstructor 314 is mounted on a horizontal plate 316, in front of the goal 312. The obstructor 314 includes two rectangular lobes: a left lobe 332*a* and a right lobe 332*b*, both attached to a vertical rotational shaft 334 (see FIG. 7 and FIG. 9). The lobes 332*a* and 332*b* are positioned such that there is one hundred and twenty degree angle between them, or rather between the planes associated with the lobes 332*a* and 332*b* (see FIG. 8A). Rotational shaft 334 extends along a horizontal axis B-B between upper and lower ends thereof. The upper and lower ends of the shaft 334 are supported by bearings 340*a* and 340*b*, respectively. The bearings 340*a* and 340*b*, are attached to front portions of upper horizontal bar 342*a* and lower horizontal bar 342*b*, respectively. Horizontal bars 342*a* and 342*b* are attached to a vertical pole 343 that in turn is attached to plate 316. Such a configuration for obstructor 314 allows rotational movement thereof about vertical axis B-B, clockwise and counterclockwise as illustrated by two-headed arrow 344.

While undisturbed, obstructor 314 stays in a stable position, shown in FIG. 7, such that lobes 332*a* and 332*b* are oriented symmetrically relative to the goal 312. The lobes 332*a* and 332*b* obstruct a line between the goal 312 and a player 348 shown in FIG. 8A when the latter stays to the left of the game apparatus (as shown in FIG. 8A) or in front of it. The initial stable position of the obstructor 314 is ensured by a spiral torsion spring 346. An inner end of the spring 346 is attached to lower portion of shaft 334 while its outer end is fixed to a vertical peg 347 raising from lower horizontal bar 342*b*, as shown in FIG. 7. If the obstructor 314 is forcefully turned about vertical axis B-B then, after the force is removed, the torsion spring 346 returns the obstructor 314 back to the initial stable position.

FIGS. 8A, 8B and 8C are consecutive snapshots of game apparatus 310 in use. FIG. 8A illustrates a moment when player 348 throws a first ball 350*a* toward the game apparatus 310. The player aims at the left lobe 332*a* in order to make the obstructor 314 turn clockwise, thereby exposing the goal 312. FIG. 8B illustrates a moment when the ball 350*a* hits left lobe 332*a* as indicated by an arrow 352. As a result of the impact, obstructor 314 starts to turn clockwise as indicated by an arrow 354. FIG. 8C illustrates a moment when the obstructor 314 has turned clockwise about ninety angular degrees thereby making goal 312 fully exposed for player 348 who is throwing a second ball 350*b* at the goal 312.

Figure 10:
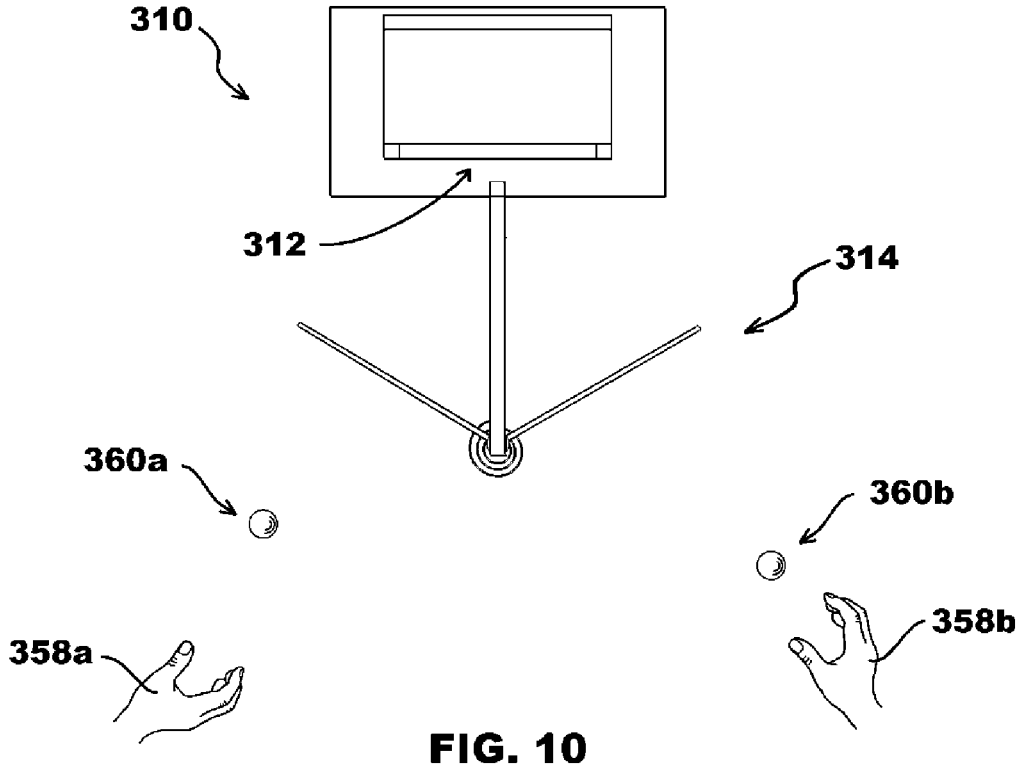
FIG. 10 is a top view of the embodiment illustrated in FIG. 7 with two players.

Game apparatus 310 can be used in a competitive game as well. FIG. 10 illustrates such a game played by two players. A left side player 358*a* and a right side player 358*b* stand ten to twelve feet away from the game apparatus 310. The right side player first throws a ball 360*a* aiming at the left lobe 332*a* of the obstructor 314 in order to make the obstructor 314 turn clockwise. Through such turn, goal 312 would be exposed for the left player and obstructed for the right player. The right side player 358*b* throws a ball 360*b* aiming at the right lobe 332*b* in order to make the obstructor 314 turn counterclockwise thereby hindering the efforts of the left side player 358*a* and to get the goal 312 exposed for the right side player 358*b*. General rules of the game are similar to the ones described herein above.

Figure 11:
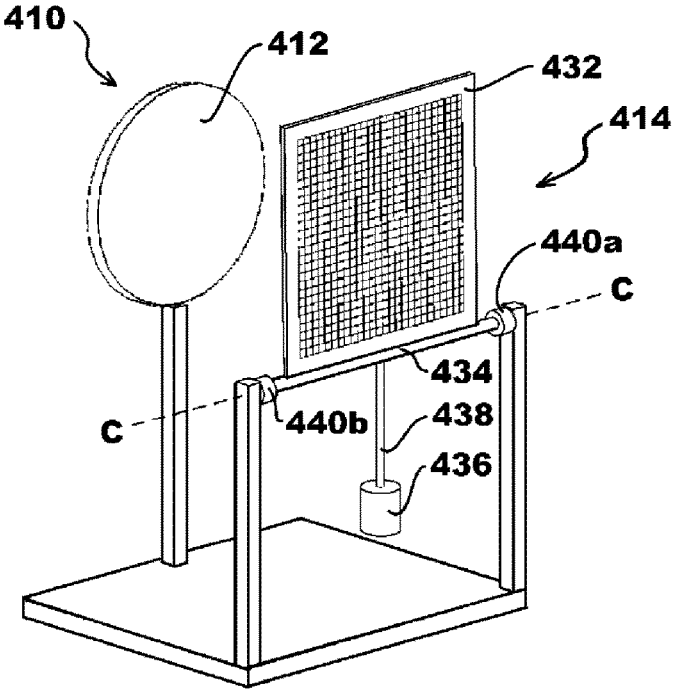
FIG. 11 is a perspective view of a fifth embodiment of the present invention having a single lobe or single protruding piece obstructor.

Still further, an embodiment of a game apparatus per the current invention having a single lobe obstructor is illustrated in FIG. 11. A game apparatus 410, similar to the embodiments illustrated in FIG. 5, has a target 412 and an obstructor 414. The obstructor 414 includes a rectangular lobe 432 attached longitudinally to a rotational shaft 434 extending along a horizontal axis C-C. Left and right ends of the rotational shaft 434 are supported by a left and right bearings 440*a* and 440*b*, respectively. A rod 438 is attached to shaft 434 such that position of the rod 438 is opposite to the one of the lobe 432 (relatively to the shaft 434). A weight 436 is attached to the outward end of the lode 432. The weight 436 serves as a counterbalance to the lobe 432, keeping the latter in the upper position while obstructor 414 is undisturbed. A length of the rod 438 is about half of the height of the lobe 432. In the upper position, oriented vertically, lobe 432 obstructs target 412. A ball hitting the lobe 432 with a sufficient force makes obstructor 414 to turn about axis C-C so exposing the target 412, similar and/or identical to the manner described hereinabove for one or more other embodiments.

In the described hereinabove game apparatus, projectiles other than balls can be used. For instance, short soft darts is a good alternative to the balls. In this case, the projectiles (the ones thrown at the obstructor or the ones that miss the goal) would not roll far away from the game apparatus so it would be easier to find and collect them. Another option is using projectiles of regular dodecahedron shape having twelve flat faces.

Figure 12C:
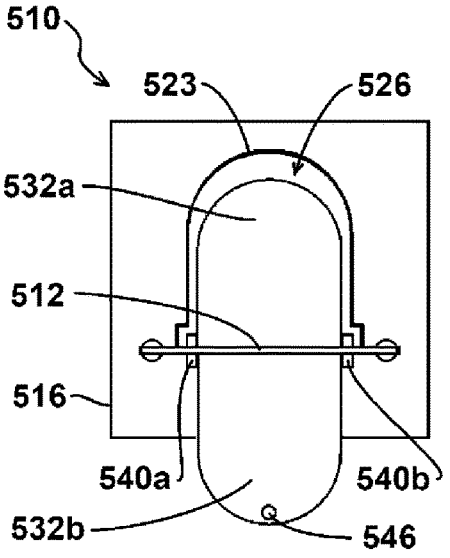
FIG. 12C is a top view of the alternate embodiment of FIG. 12A with the obstructor of FIG. 12A in a second state.
Figure 12A:
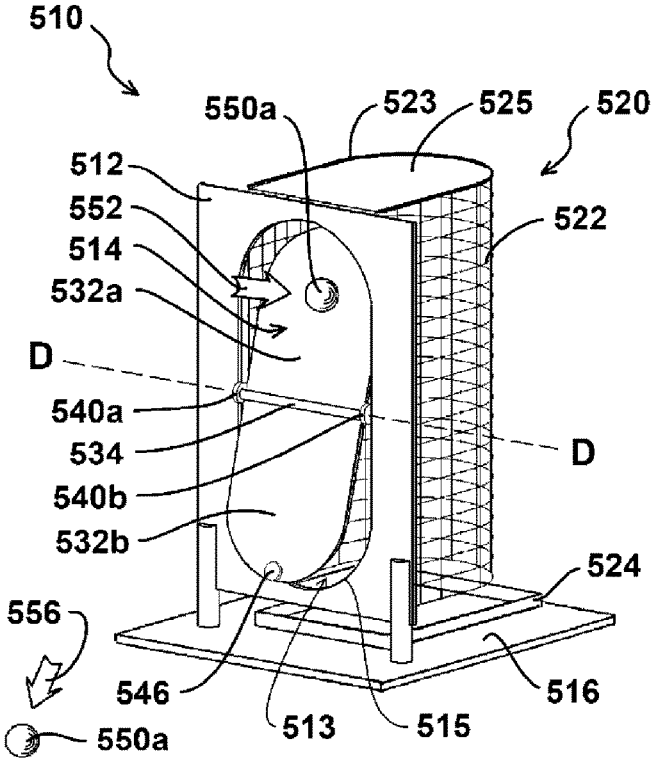
FIG. 12A is a perspective view of an alternate embodiment having a shield with an opening with an obstructor in a first state.
Figure 12B:
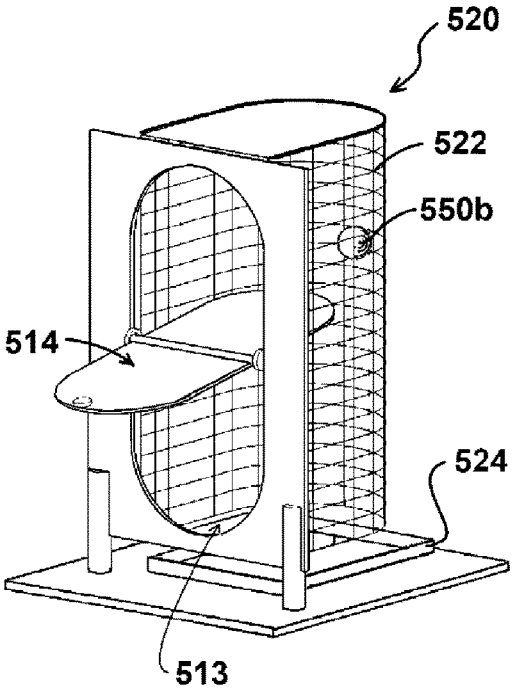
FIG. 12B is a perspective view of the alternate embodiment of FIG. 12A with the obstructor of FIG. 12A in a second state.

Still another embodiment of the present invention is shown in FIGS. 12A and 12B. As illustrated in FIG. 12A, a game apparatus 510 has an obstructor 514, a ball receiver 520 and a shield 512 is mounted on a horizontal plate 516. Shield 512 has an opening 513 having edge 515. Shield 512 is made preferably of a thin hardboard. A front surface of the shield 512 is covered by a thin soft material in order to absorb the energy of balls hitting the shield 512. Through that, the balls do not run far away in the course of the game.

Obstructor 514 has lobes 532*a* and 532*b*, both attached longitudinally to a rotational shaft 534. Shaft 534 extends along a horizontal axis D-D between left and right ends thereof, the ends are supported by left and right bearings 540*a* and 540*b*, respectively. Bearings 540*a* and 540*b* are attached to left and right portions of the opening's edge 515, respectively. The size and shape of opening 513 are such that there is a clearance between the opening's edge and the lobes when the obstructor 514 is oriented vertically or almost vertically, as in FIG. 12A. Ball receiver 520 positioning behind shield 512 includes a frame 523 attached to top of the shield's back and a net 522. The latter is attached to frame 523 and is hanging down. The size and shape of the ball receiver 520 are such that there is a clearance 526 between the net veil 522 and one of the lobes 532*a* and 532*b* that is closest to the net veil 522 when the obstructor 514 is oriented horizontally, as illustrated in a top view of the game apparatus 510 in FIG. 12C (for clarity, cover 525 of the ball receiver 520 and ball collector 524 are removed in FIG. 12C). Thereby, obstructor 514 is able to rotate freely about horizontal axis D-D. As it is seen in FIG. 12A, the horizontal axis D-D lies in the premises of the shield 512. However, the connection between the rotational shaft 534 and the shield 512 can be configured such that the axis D-D lies in front of the shield 512 or behind it.

A small weight 546 is attached to lobe 532*b*. The weight causes obstructor 514 to stay initially in vertical or almost vertical orientation having lobe 532*a* up and lobe 532*b* down as in FIG. 12A thereby obstructing the ball receiver 520. A first ball 550*a* thrown by a player hits lobe 532*a* as indicated by an arrow 552. After being bounced back, first ball 550*a* lands near the game apparatus 510 as indicated by an arrow 556. The impact makes the obstructor 514 turn. FIG. 12B illustrates a moment of time when obstructor 514 is oriented almost horizontally thereby making ball receiver 520 exposed through opening 513. A second ball 550*b* thrown by the player flies through the opening 513 then hits back portion of net veil 522 as shown in FIG. 12B. Immediately after that, the ball 550*b* drops down to ball collector 524.

Effectively, opening 513 in the shield serves as an aperture of ball receiver 520. In the embodiments described herein above, the goal (as in FIG. 1) and the target (as in FIG. 5) are functioning as ball receivers or registrators, same as in the embodiment shown in FIG. 12A. In that regard, a difference between these embodiments is in boundaries of the ball receivers. In the embodiment as per FIG. 12A the boundaries are defined by opening 513; in the goal embodiment, the boundaries are defined by the goal's posts and horizontal bars; and in the target embodiment, the boundaries are defined by edges of the target.

It should be understood that different embodiments of the ball receivers or registrators are contemplated. For instance, the ball receiver/registrator can be implemented as an electronic device capable of detecting balls passing through opening 513 in shield 512, similar to devices used in running races for detecting runners crossing the finish line, based on radio-frequency identification.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. A game apparatus comprising:

an obstructing member, and a target member connected to the obstructing member;

wherein the target member includes a structure surrounding an opening;

and a tunnel connected to the target member, wherein the opening of the target member leads to the tunnel;

wherein the obstructing member is rotationally supported by a supporting means;

wherein the obstructing member is configured to be rotated about a rotational axis from a first orientation to a second orientation with respect to the target member;

wherein in the first orientation, a projection of outside contour of the obstructing member covers a first portion of the opening of the target member;

wherein in the second orientation, a projection of outside contour of the obstructing member covers a second portion of the of the opening of the target member that is smaller than the first portion of the opening of the target member;

wherein the obstructing member includes a first protruding piece and a second protruding piece;

wherein the first protruding piece projects out perpendicularly to the rotational axis a first distance from the rotational axis in a first direction and the second protruding piece projects out perpendicularly to the rotational axis, a second distance from the rotational axis in a second direction which is different from the first direction;

wherein the target member and the obstructing member are connected such that the rotational axis of the obstructing member is substantially parallel to the opening; and wherein the rotational axis of the obstructing member and the opening are separated by a distance which is greater than either of the first and the second distances.

2. The game apparatus of claim 1 wherein the first and the second protruding pieces have a substantially the same shape.

3. The game apparatus of claim 2 wherein the first and the second protruding pieces project out from the rotational axis in opposite directions.

4. The game apparatus of claim 1 wherein the rotational axis is oriented substantially horizontally.

5. The game apparatus of claim 4 wherein the second protruding piece is heavier than the first protruding piece.

6. The game apparatus of claim 1 wherein the structure surrounding the opening of the target member is a frame; and wherein the tunnel is configured to capture projectiles passing through the frame at the opening of the target member.

7. The game apparatus of claim 6 wherein the tunnel has an upper portion attached to the frame.

8. The game apparatus of claim 7 further comprising a projectile collector configured as a container positioned under an opening in a lower portion of the tunnel.

9. The game apparatus of claim 1 wherein at least one of the first and the second protruding pieces is configured as a frame with a netting fixed to the frame and stretched across the frame.

10. The game apparatus of claim 1 wherein the structure surrounding the opening of the target member is a loop with the opening at a center of the loop and the loop has a front side and a rear side.

11. The game apparatus of claim 10 wherein the tunnel is attached to the rear side of the loop.

12. The game apparatus of claim 10 wherein the tunnel is configured as an enclosure having an opening facing the opening at the center of the loop.

13. The game apparatus of claim 1 wherein the rotational axis is oriented substantially vertically.

14. The game apparatus of claim 1 further comprising a base which connects the target member with the obstructing member; and wherein the rotational axis is oriented substantially parallel to the base.

15. The game apparatus of claim 1 wherein the obstructing member is configured such that the obstructing member will remain in a stable state at the first orientation with respect to the target member, until there is a sufficient external force from a particular direction, which will cause the obstructing member to rotate with respect to the target member, and upon removal of the external force, the obstructing member will settle back into its stable state.

16. A game apparatus comprising:

an obstructing member; and a target member connected to the obstructing member; and wherein the target member has a front side and rear side;

wherein the target member includes a structure surrounding an opening lying substantially in a first plane;

wherein the target member includes a tunnel connected to the rear side of the target member and wherein the opening of the target member leads to the tunnel;

wherein the tunnel is configured to capture one or more projectiles passing through the opening from the front side of the target member;

wherein the obstructing member is positioned in front of the front side of the target member and is rotationally supported by a supporting means;

wherein the obstructing member is configured to be rotated about a rotational axis from a first orientation to a second orientation with respect to the target member;

wherein in the first orientation, a projection of outside contour of the obstructing member on the first plane covers a first portion of the opening of the target member;

wherein in the second orientation, a projection of outside contour of the obstructing member on the first plane covers a second portion of the opening of the target member, wherein the second portion is smaller than the first portion;

wherein the obstructing member includes a first protruding piece and a second protruding piece;

wherein the first protruding piece projects out perpendicularly to the rotational axis a first distance from the rotational axis in a first direction and the second protruding piece projects out perpendicularly to the rotational axis a second distance from the rotational axis in a second direction which is different from the first direction;

wherein the target member and the obstructing member are connected such that the rotational axis of the obstructing member is substantially parallel to the first plane; and wherein the rotational axis of the obstructing member and the first plane are separated by a distance which is greater than either of the first and the second distances.

17. The game apparatus of claim 16 wherein at least one of the first and the second protruding pieces is configured as a frame with a netting fixed to the frame and stretched across the frame.

18. A game apparatus comprising an obstructing member;

a target member connected to the obstructing member;

wherein the target member includes a structure surrounding an opening lying substantially in a first plane;

wherein the obstructing member is rotationally supported by a supporting means;

wherein the obstructing member is configured to be rotated about a rotational axis from a first orientation to a second orientation with respect to the target member;

wherein in the first orientation a projection of outside contour of the obstructing member on the first plane covers a first portion of the opening of the target member;

wherein in the second orientation a projection of outside contour of the obstructing member on the first plane covers a second portion of the opening of the target member wherein the second portion is smaller than the first portion;

wherein the obstructing member includes a first protruding piece and a second protruding piece;

wherein the first protruding piece projects out perpendicularly to the rotational axis a first distance from the rotational axis in a first direction and the second protruding piece projects out perpendicularly to the rotational axis a second distance from the rotational axis in a second direction from the rotational axis which is different from the first direction; and wherein the target member and the obstructing member are connected such that the rotational axis of the obstructing member is substantially parallel to the first plane;

wherein the rotational axis of the obstructing member and the first plane are separated by a distance which is greater than either of the first and the second distances; and wherein the apparatus is configured such that a first projectile striking one of the protruding pieces at a particular angle, when the obstructing member is in the first orientation, causes the obstructing member to rotate toward the second orientation; such that movement, in a straight line, of a second projectile from a first location to the opening of the target member is blocked when the obstructing member is in the first orientation, and movement, in a straight line, of the second projectile from the first location to the opening of the target member is not blocked when the obstructing member is in the second orientation wherein the target member has a front side and a rear side;

wherein the obstructing member is positioned in front of the front side of the target member;

wherein the target member includes a tunnel connected to the rear side of the target member and wherein the opening of the target member leads to the tunnel.

* * * * *